US012022928B2

(12) United States Patent
Henslee

(10) Patent No.: US 12,022,928 B2
(45) Date of Patent: Jul. 2, 2024

(54) STORAGE DEVICE

(71) Applicant: Wyatt Henslee, Bonners Ferry, ID (US)

(72) Inventor: Wyatt Henslee, Bonners Ferry, ID (US)

(73) Assignee: Wyatt Henslee, Bonners Ferry, ID (US)

( * ) Notice: Subject to any disclaimer, the term of this patent is extended or adjusted under 35 U.S.C. 154(b) by 0 days.

(21) Appl. No.: 17/740,210

(22) Filed: May 9, 2022

(65) Prior Publication Data

US 2022/0354228 A1 Nov. 10, 2022

Related U.S. Application Data

(60) Provisional application No. 63/186,547, filed on May 10, 2021.

(51) Int. Cl.

| | |
|---|---|
| ***A45C 7/00*** | (2006.01) |
| ***A45C 13/00*** | (2006.01) |
| ***A45C 13/10*** | (2006.01) |
| ***A45F 3/00*** | (2006.01) |
| ***A45F 5/00*** | (2006.01) |
| ***B65D 85/00*** | (2006.01) |

(52) U.S. Cl.

CPC ..... *A45C 7/0063* (2013.01); *A45C 13/008* (2013.01); *A45C 13/103* (2013.01); *A45F 3/00* (2013.01); *B65D 85/542* (2013.01); *A45F 2005/006* (2013.01)

(58) Field of Classification Search

CPC ... A45C 13/008; A45C 13/103; A45C 7/0063; B65D 85/542

USPC ..... 383/22; 220/500

See application file for complete search history.

(56) References Cited

U.S. PATENT DOCUMENTS

| | | | | |
|---|---|---|---|---|
| 1,540,024 | A | 6/1925 | Larsen | |
| 3,834,497 | A | 9/1974 | Furst | |
| 4,526,307 | A * | 7/1985 | Parker | E04H 15/04 224/154 |
| 5,860,175 | A | 1/1999 | Saiki | |
| 2004/0006820 | A1 | 1/2004 | Saiki | |
| 2008/0002107 | A1 | 9/2008 | Gallaway | |
| 2010/0078456 | A1 | 4/2010 | Mottram et al. | |

(Continued)

OTHER PUBLICATIONS

Amazon.com: Eureka! Universal Dome Style Tent Gear Loft: Tent . . . (n.d.). https://www.amazon.com/Eureka-Universal-Dome-Style-Tent/dp/B0013RD4BG (Year: 2004).*

(Continued)

*Primary Examiner* — Robert J Hicks
*Assistant Examiner* — Sanjidul Islam
(74) *Attorney, Agent, or Firm* — Lee & Hayes, P.C.

(57) ABSTRACT

The present application discloses a device including a first triangular panel, a second triangular panel, a first side panel coupling the first triangular panel and the second triangular panel at a first common side of the first triangular panel and the second triangular panel, a second side panel coupling the first triangular panel and the second triangular panel at a second common side of the first triangular panel and the second triangular panel, a bottom panel coupling the first triangular panel, the second triangular panel, the first side panel, and the second side panel, and at least one shelf coupled in an interior of the first triangular panel, the second triangular panel, the first side panel, and the second side panel.

17 Claims, 7 Drawing Sheets

(56) References Cited

U.S. PATENT DOCUMENTS

| | | | |
|---|---|---|---|
| 2010/0276241 | A1 | 11/2010 | Malone |
| 2014/0299505 | A1 | 10/2014 | Stahle |

OTHER PUBLICATIONS

Rei, "Black Diamond: Black Diamond Deluxe Cliff Cabana Double Fly," downloaded on May 12, 2022 from https://www.rei.com/product/889764/black-diamond-deluxe-cliff-cabana-double-fly.

Safari Supply, "Marmot: Marmot Birdhouse Shelf Hanging Tent Organizer," downloaded on May 12, 2022 from https://safari-supply.com/products/marmot-birdhouse-shelf-hanging-tent-organizer/?gclid=EAIaIQobChMI39_2qafJ7gIV8SCtBh2ANQI5EAQYBiABEgL0s_D_BwE, 6 pages.

Walmart, "Knowza: Camping Dry Net-4 Layer Outdoor Hanging Foldable Drying Rack, Camping Organizer Mesh Dryer Storage for Home Picnic BBQ Tableware/Dishes/Food/Vegetables/Fruit/" downloaded on May 12, 2022 from https://www.walmart.com/ip/Camping-Dry-Net-4-Layer-Outdoor-Hanging-Foldable-Drying-Rack-Organizer-Mesh-Dryer-Storage-Home-Picnic-BBQ-Tableware-Dishes-Food-Vegetables-Fruit-Clot/426666714, 6 pages.

International Search Report and Written Opinion of the International Searching Authority, mailed Sep. 8, 2022, for International Application No. PCT/US2022/028386, 7 pages.

* cited by examiner

STORAGE DEVICE

RELATED APPLICATION(S)

This application claims the benefit of priority provisional U.S. Application No. 63/186,547, filed May 10, 2021, which is incorporated herein by reference in its entirety.

TECHNICAL FIELD

The present disclosure relates generally to storage devices. Specifically, the present disclosure relates to storage devices for use in outdoor activities such as hiking or camping.

BACKGROUND

Storage devices assist a user in organizing and/or securing possessions. A storage device may take any form and may be used to convey possessions from one location to another. In an outdoor context such as hiking or camping where an individual may seek to bring several items into a recreational areas, it may be convenient and even necessary to store certain items in a storage device. However, organization of these items may prove difficult as the user may be carrying those items in a backpack and the user may find it difficult to organize and access items within the backpack. For example, the user may be required to dig through their items within the backpack to obtain a certain item. Having to dig through the backpack may require the user to remove items from the backpack, search for the desired item, and then repack the backpack. Further, certain items such as food may be required to be stored separately from the user so that wildlife such as bears, cougars, and other predatory animals may be a threat to the user if the user were to store food in their tent or generally in their immediate presence.

BRIEF DESCRIPTION OF THE DRAWINGS

The detailed description is set forth below with reference to the accompanying figures. In the figures, the left-most digit(s) of a reference number identifies the figure in which the reference number first appears. The use of the same reference numbers in different figures indicates similar or identical items. The systems depicted in the accompanying figures are not to scale and components within the figures may be depicted not to scale with each other.

OVERVIEW

Figure 1:
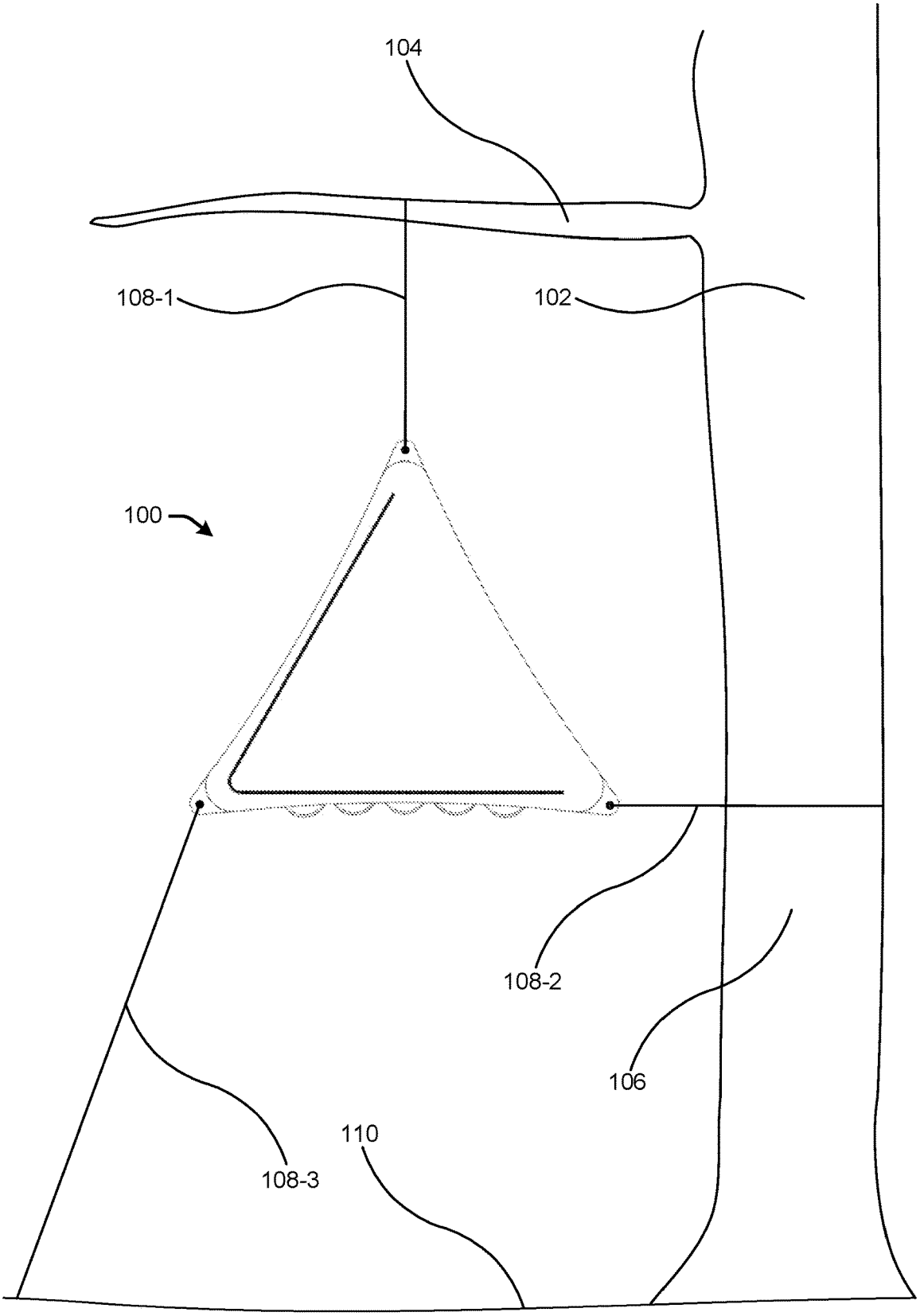
FIG. 1 illustrates a storage device deployed in a functional manner, according to an example of the principles described herein.

In the examples described herein, a collapsible, ambulatory, and lightweight storage device is described herein. The storage device may be used in situations where a user may benefit from these and other features of the storage device such as, for example, hiking, camping, hoteling, and similar situations. In outdoor situations such as hiking and camping, instead of unloading gear or other objects from the user's backpack onto the ground while camp is set up, the user may place their gear and other objects in the present storage device to keep those items clean and dry.

Examples described herein provide a device including a first triangular panel and a second triangular panel. The device further includes a first side panel coupling the first triangular panel and the second triangular panel at a first common side of the first triangular panel and the second triangular panel and a second side panel coupling the first triangular panel and the second triangular panel at a second common side of the first triangular panel and the second triangular panel. The device further includes at least one shelf coupled in an interior of the first triangular panel, the second triangular panel, the first side panel, and the second side panel.

The device further includes a bottom panel coupling the first triangular panel, the second triangular panel, the first side panel, and the second side panel. The device further includes at least one loop coupled to an exterior of the bottom panel. The first triangular panel, the second triangular panel, the first side panel, the second side panel, and the bottom panel include a water-resistant or water-proof material. The at least one shelf includes a mesh material such as a nylon mesh material.

The device further includes at least one rib extending from an interior side of the first triangular panel to an interior side of the second triangular panel to expand the interior of the first triangular panel, the second triangular panel, the first side panel, the second side panel, and the bottom panel. The at least one rib includes aluminum. The device further includes a number of grommets formed in a number of corners of the device, the grommets creating a number of apertures for securing the device. The ribs are configured to engage with a respective pair of the grommets.

The device further includes at least one opening located on at least one of the first triangular panel or the second triangular panel. The opening includes at least one zipper coupled to the opening to selectively open and close the opening.

Examples described herein also provide a rectangular pyramid storage device. The rectangular pyramid storage device includes a first triangular panel, a second triangular panel, a first side panel coupling the first triangular panel and the second triangular panel at a first common side of the first triangular panel and the second triangular panel, a second side panel coupling the first triangular panel and the second triangular panel at a second common side of the first triangular panel and the second triangular panel, and a bottom panel coupling the first triangular panel, the second triangular panel, the first side panel, and the second side panel.

The rectangular pyramid storage device further includes at least one shelf coupled in an interior of the first triangular panel, the second triangular panel, the first side panel, and the second side panel. The at least one shelf includes a mesh material. The rectangular pyramid storage device further includes at least one loop coupled to an exterior of the bottom panel.

The rectangular pyramid storage device further includes at least one rib extending from an interior side of the first triangular panel to an interior side of the second triangular panel to expand the interior of the first triangular panel, the second triangular panel, the first side panel, the second side panel, and the bottom panel, wherein the at least one rib includes aluminum. The rectangular pyramid storage device further includes a number of grommets formed in a number of corners of the rectangular pyramid storage device, the grommets creating a number of apertures for securing the rectangular pyramid storage device, wherein the at least one rib is configured to engage with a respective pair of the grommets. The at least one rib includes aluminum.

The rectangular pyramid storage device further includes at least one opening located on at least one of the first triangular panel or the second triangular panel. The opening includes at least one zipper coupled to the opening to selectively open and close the opening.

Additionally, the techniques described in this disclosure may be performed as a method and/or by a system having non-transitory computer-readable media storing computer-executable instructions that, when executed by one or more processors, performs the techniques described above.

EXAMPLE EMBODIMENTS

Turning now to the figures, FIG. 1 illustrates a storage device 100 deployed in a functional manner, according to an example of the principles described herein. As depicted in FIG. 1, the storage device is deployed in an outdoor environment such as a wooded area or the like. However, the present systems and devices may be deployed in any instance in which items may be stored.

In the example of FIG. 1, the storage device 100 may be hung and secured from movement in at least one coordinate direction via the use of a number of tethers 108-1, 108-2, 108-3 (collectively referred to as "tether(s) 108"). For example, the storage device 100 may be hung from an overhanging surface such as a limb 104 of a tree 102 via a first tether 108-1. In this manner, the storage device 100 may be suspended from the overhanging surface to allow an individual to access the interior portions of the storage device 100. In one example, the storage device 100 may be hung at a height within reach of the individual to allow such access. In another example, the first tether 108-1 may be lengthened or shortened to allow for the storage device 100 to be hung at any height. In one example, the first tether 108-1 may be shortened to allow for the storage device 100 to be hung at a higher height to secure the storage device out of reach of other individuals or animals (e.g., bears should the user be storing food in the storage device 100). In one example, the tethers 108 may be made of paracord or other types of rope.

Further, a second tether 108-2 and a third tether 108-3 may be coupled to two other corners of the storage device 100 to further secure the storage device 100 such that it may not swing freely from the first tether 108-1. For example, the second tether 108-2 and/or the third tether 108-3 may secure the storage device 100 to a trunk 106 of the tree 102 and/or the ground 110 as depicted in FIG. 1.

Figure 2:
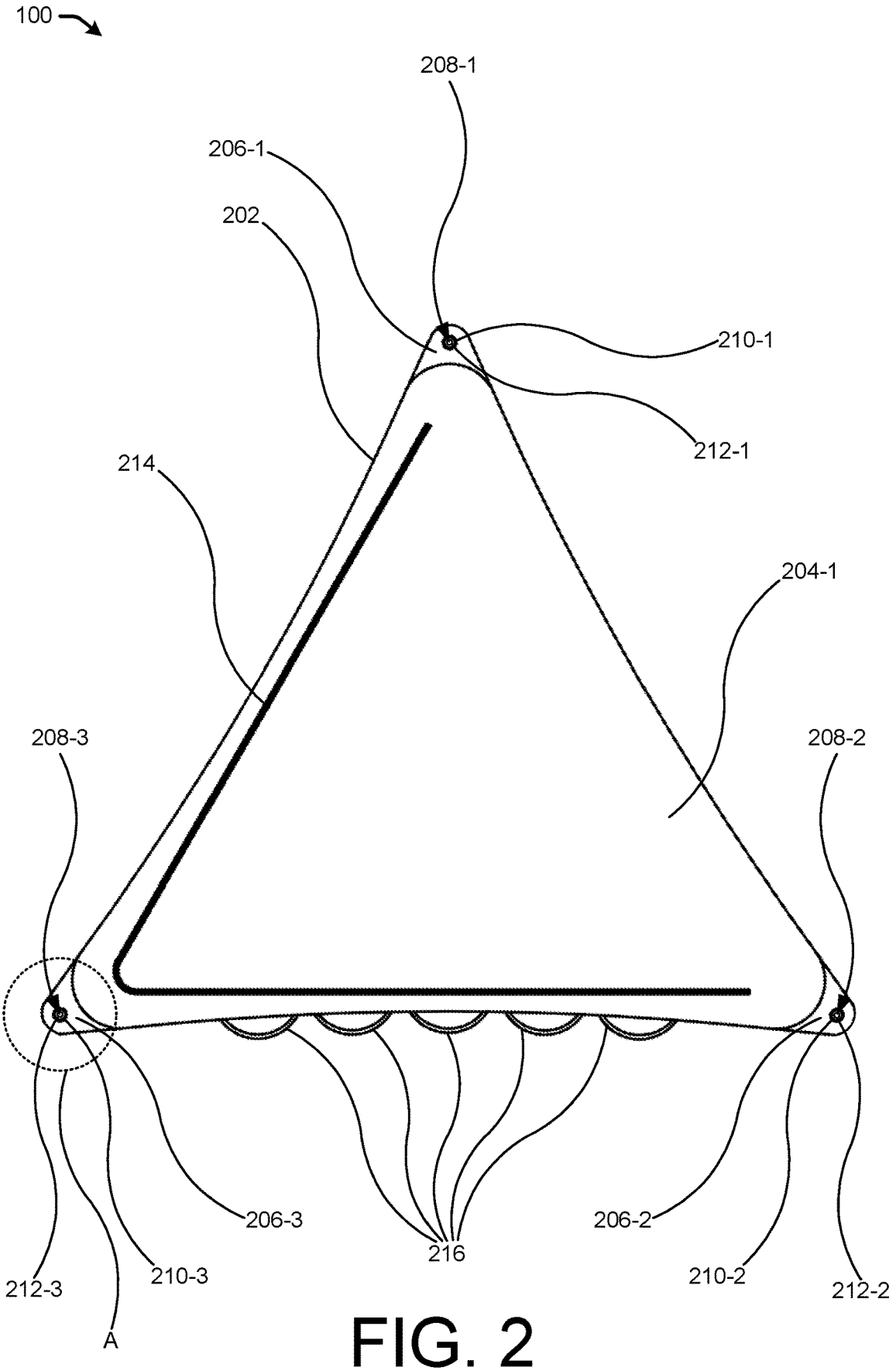
FIG. 2 illustrates a front elevational view of a first side of the storage device of FIG. 1, according to an example of the principles described herein.
Figure 4:
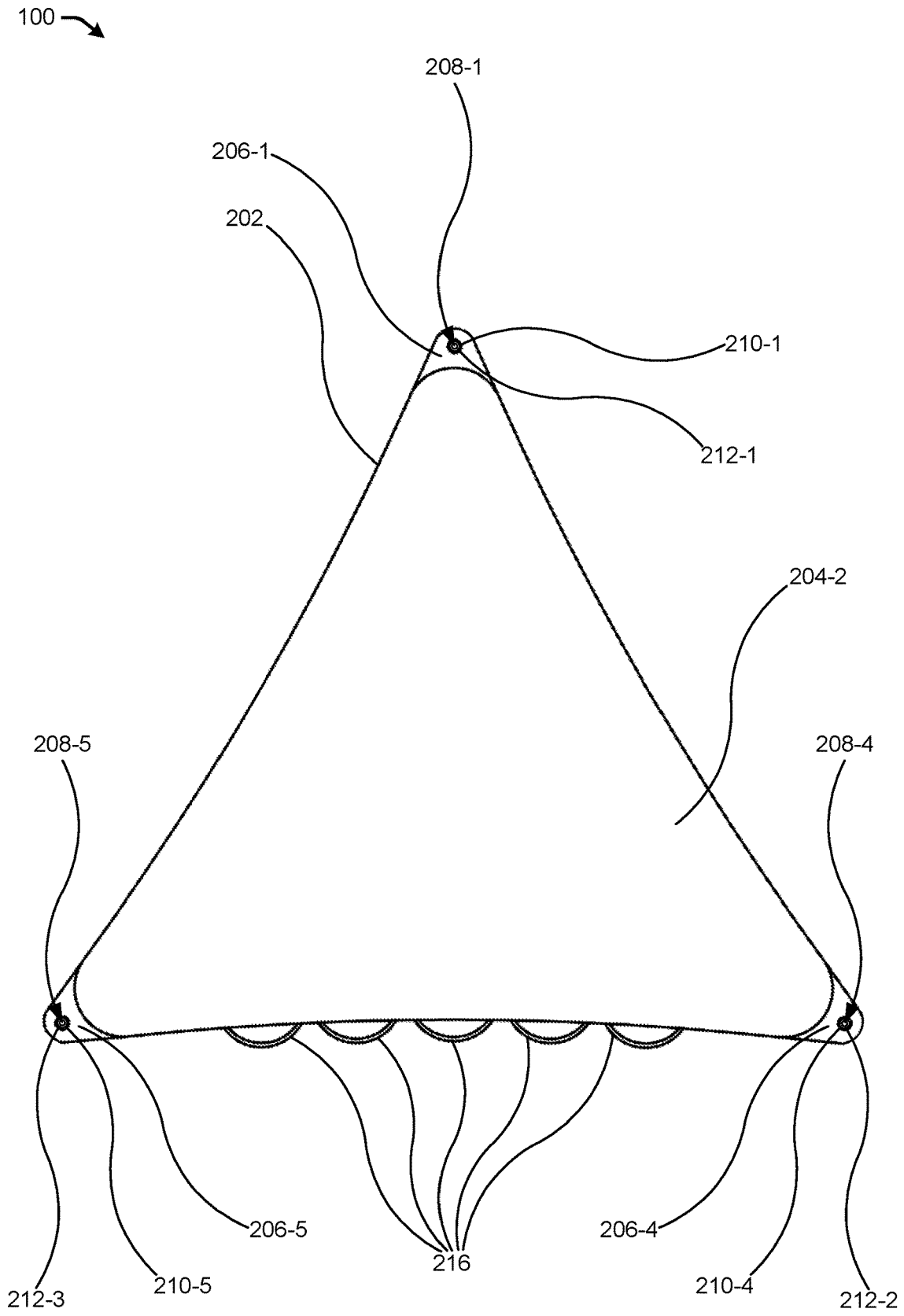
FIG. 4 illustrates a front elevational view of a second side of the storage device of FIG. 1, according to an example of the principles described herein.
Figure 5:
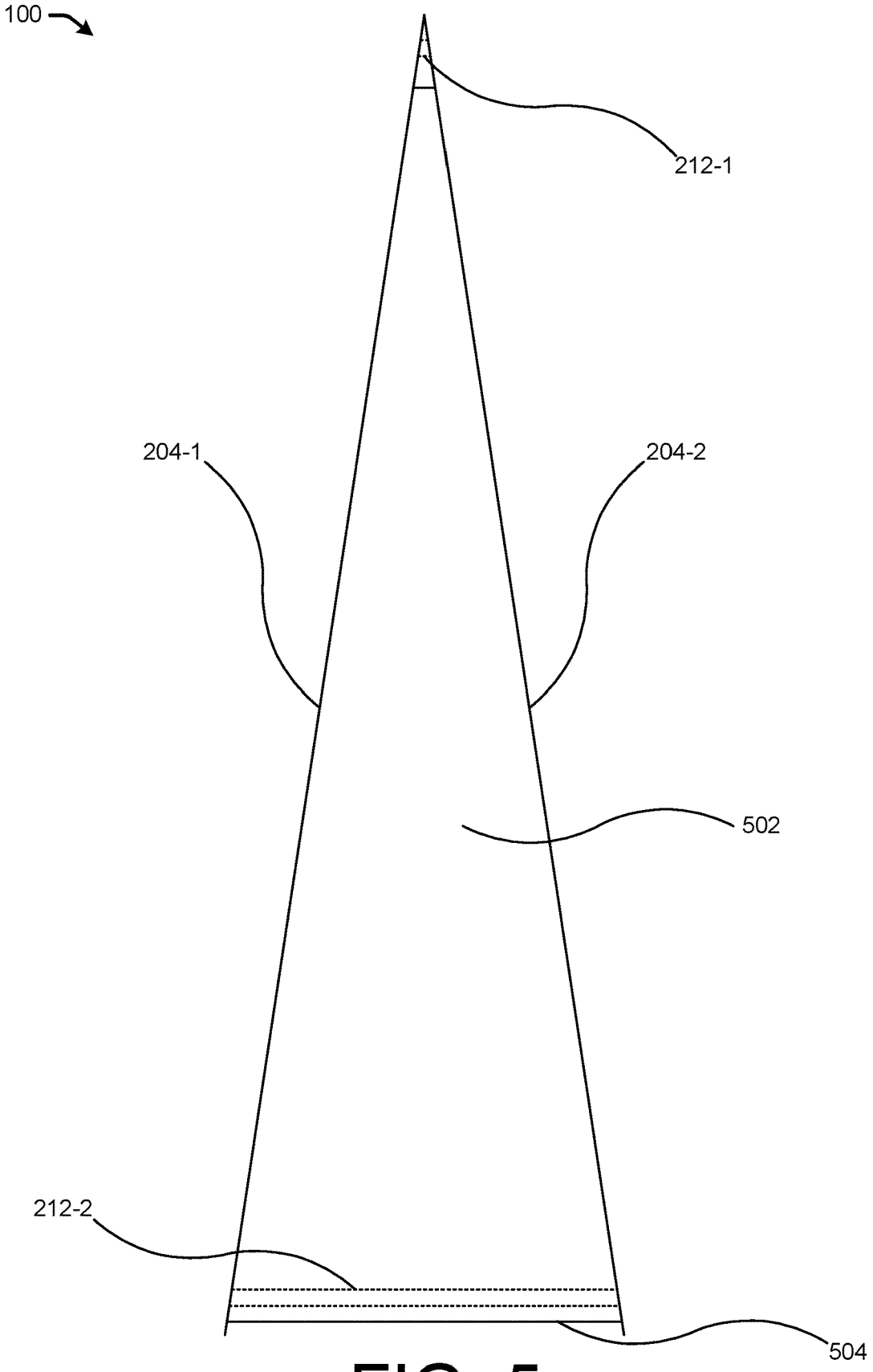
FIG. 5 illustrates a first side elevational view of the storage device of FIG. 1, according to an example of the principles described herein.
Figure 6:
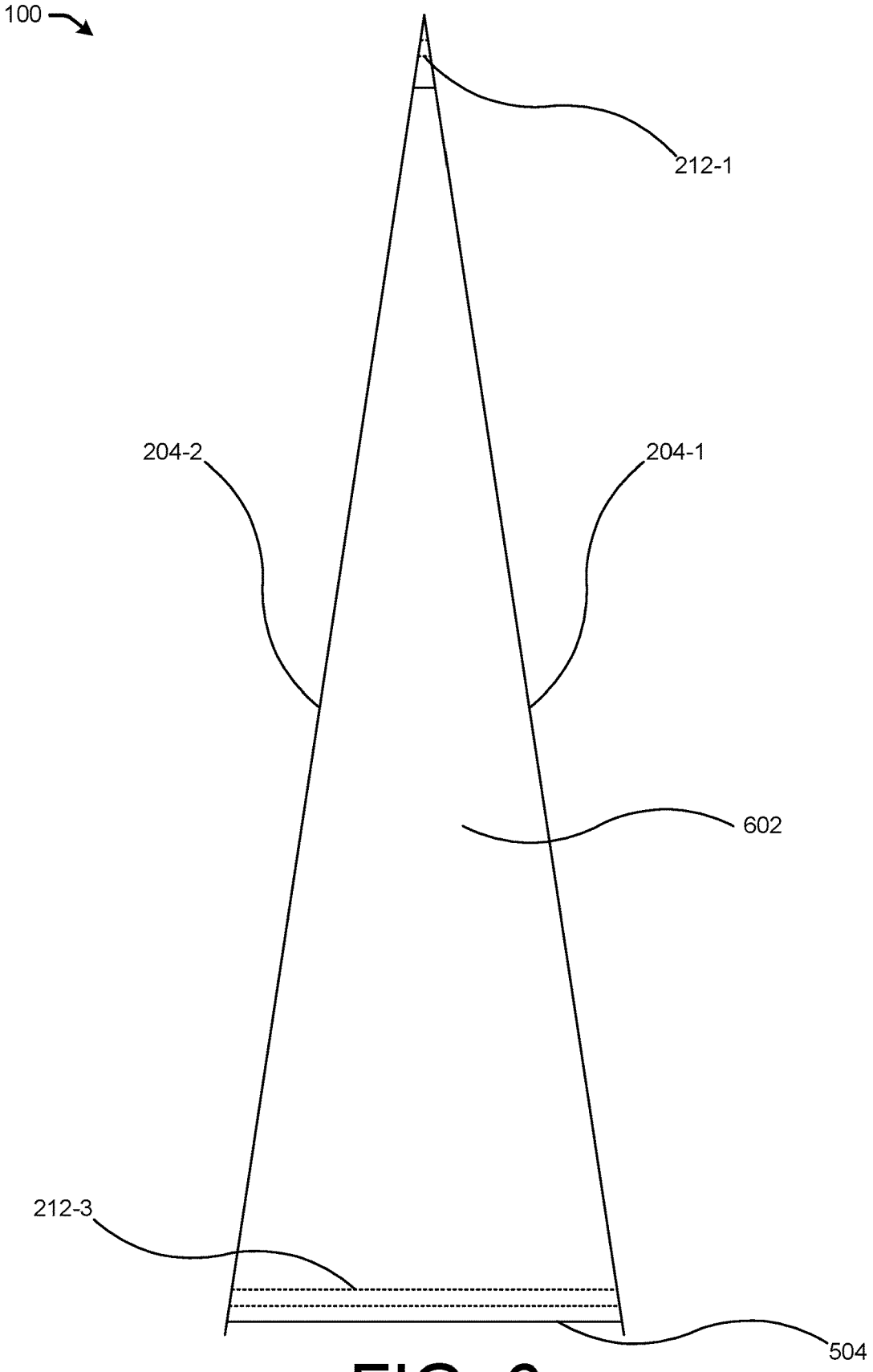
FIG. 6 illustrates a second side elevational view of the storage device of FIG. 1, according to an example of the principles described herein.

Having described the manner in which the storage device 100 is deployed and utilized, the features of the storage device 100 will now be described in more detail. FIG. 2 illustrates a front elevational view of a first side of the storage device 100 of FIG. 1, according to an example of the principles described herein. FIG. 4 illustrates a front elevational view of a second side of the storage device 100 of FIG. 1, according to an example of the principles described herein. FIG. 5 illustrates a first side elevational view of the storage device 100 of FIG. 1, according to an example of the principles described herein. Further, FIG. 6 illustrates a second side elevational view of the storage device 100 of FIG. 1, according to an example of the principles described herein. The storage device 100 may include five surfaces formed together to create an enclosure 202. The five surfaces may include a first triangular panel 204-1 as depicted in FIGS. 2, 5, and 6. Further, five surfaces may include a second triangular panel 204-2 depicted in FIG. 4 and the cut-away view of the storage device 100 in FIG. 5. The five surfaces may further include a first side panel 502 coupling the first triangular panel 204-1 and the second triangular panel 204-2 at a first common side of the first triangular panel 204-1 and the second triangular panel 204-2. The five surfaces may further include a second side panel 602 coupling the first triangular panel 204-1 and the second triangular panel 204-2 at a second common side of the first triangular panel 204-1 and the second triangular panel 204-2. The five surfaces may further include a bottom panel 504 coupling, at a second common side, the first triangular panel 204-1, the second triangular panel 204-2, the first side panel 502, and the second side panel 602, and serves as a base to the storage device 100.

As depicted in FIGS. 1, 2, and 4-7, the storage device 100 has a rectangular pyramid shape. Specifically, the first triangular panel 204-1 and the second triangular panel 204-2 have a first triangular shape that forms two of the five sides. In one example, the first triangular shape of the first triangular panel 204-1 and the second triangular panel 204-2 may have an approximately equilateral triangular shape. The first side panel 502 and the second side panel 602 have a second triangular shape that forms two additional sides of the five sides of the storage device 100. In one example, the first side panel 502 and the second side panel 602 have an approximately isosceles triangle shape such that the depth of the storage device 100 is shorter than the width as viewed from the perspective depicted in FIGS. 1 and 2. In one example, the first triangular panel 204-1 and the second triangular panel 204-2 may have approximately 24 inch (in.) sides.

The rectangular pyramid shape of the storage device 100 further includes a base in the form of the bottom panel 504. The bottom panel 504 may have an approximately rectangular shape. Further, in one example, the bottom panel 504 may have an approximately 24 in. length and an approximately 10 in. width. Further, with these dimensions, the storage device 100 may provide for various sizes of compartments within the storage device 100. Although, in the examples described herein, dimensions of the first triangular panel 204-1, the second triangular panel 204-2, the first side panel 502, the second side panel 602, and the bottom panel 504, these panels may have other dimensions that provide for relatively smaller or larger dimensions individually and/or collectively.

The first triangular panel 204-1, the second triangular panel 204-2, the first side panel 502, the second side panel 602, and the bottom panel 504 may be coupled to one another as described herein via any coupling means and/or method. For example, the first triangular panel 204-1, the second triangular panel 204-2, the first side panel 502, the second side panel 602, and the bottom panel 504 may be coupled to one another via sewing, stitching, welding (e.g., chemical welding, heat welding, etc.), taping, gluing, coupling using mechanical devices, other coupling devices and methods, and combinations thereof. Further, in one example, the first triangular panel 204-1, the second triangular panel 204-2, the first side panel 502, the second side panel 602, and the bottom panel 504 as well as the areas at which these panels couple to one another may be made to be water-resistant or water-proof including being made of water-resistant or water-proof material and/or including water-resistant or water-proof elements to seal the areas at which these panels couple to one another and the panels themselves. In one example, the first triangular panel 204-1, the second triangular panel 204-2, the first side panel 502, the second side panel 602, and the bottom panel 504 may be made of any material including for example, polyester, oxford polyester, cotton (e.g., canvas), nylon, felt, plastics, other materials, and combinations thereof. Further, the materials of the panels 204-1, 204-2, 502, 602 may be coated with a water-resistant and/or water-proof coating such as, for example, paraffin, beeswax, mink oil, silicone, polyurethane, organofluorine, nanotextured surfacing, hydrophobic substances, superhydrophobic substances, other coatings, and combinations thereof.

In conjunction with the description of FIGS. 1, 2, and 4, FIG. 3 illustrates a front elevational view of portion A of FIG. 2, according to an example of the principles described herein. In one example, a number of tabs 206-1, 206-2, 206-3, 206-4, 206-5, collectively referred to as "tab(s) 206"), may be included at the corners of the storage device 100. The tabs 206 may be formed by collecting corners of adjacent panels together and sewing further into the field of the panels away from the edges. For example, tab 206-3 may include corners of the first triangular panel 204-1, the second side panel 602, and/or the bottom panel 504 collected together with a half-moon shaped stich or other separating element that structurally segregates the tab from the first triangular panel 204-1, the second side panel 602, and the bottom panel 504. In one example, the tabs 206 may include portions of the panels welded together to create the tabs 206 and the half-moon shaped element. In another example, the tab 206-1 may include corners of the first triangular panel 204-1, second triangular panel 204-2, the first side panel 502, and the second side panel 602 collected together with a half-moon shaped stich or other separating element that structurally segregates the tab from the first triangular panel 204-1, second triangular panel 204-2, the first side panel 502, and the second side panel 602.

Figure 3:
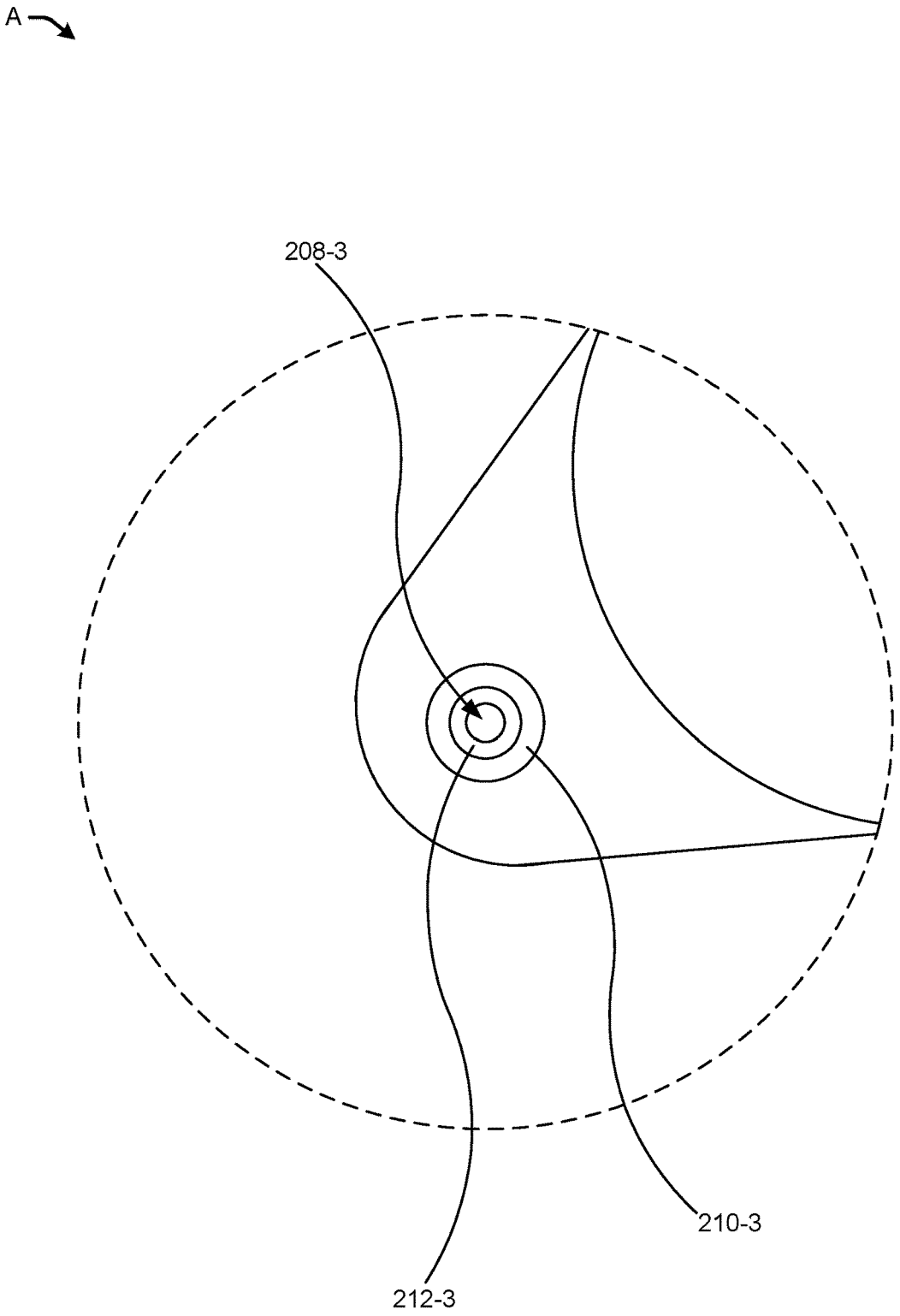
FIG. 3 illustrates a front elevational view of portion A of FIG. 2, according to an example of the principles described herein.

As depicted in FIG. 3 as well as FIGS. 1, 2, and 4-7, the tabs 206 are formed to allow for a number of apertures 208-1, 208-2, 208-3, 208-4, 208-5 (collectively referred to as "aperture(s) 208") to be formed therein. The apertures 208 may include corresponding grommets 210-1, 210-2, 210-3, 210-4, 210-5 (collectively referred to as "grommet(s) 210") coupled such that the grommets 210 encircle the apertures 208. In one example, the affixing of the grommets 210 to the tabs 206 of the storage device 100 may be the means by which the apertures 208 are formed in the tabs 206. In one example, the grommets 210 may be made of any material including plastics, metals, metal alloys, other materials, and combinations thereof.

As to aperture 208-1 and grommet 210-1, a single grommet and corresponding aperture may be formed since the first triangular panel 204-1, the second triangular panel 204-2, the first side panel 502, and the second side panel 602 couple to one another at the first tab 206-1 with no or little intervening space. However, in one example, two apertures and two grommets may be included in tab 206-1. Similarly, as to aperture 208-2 and grommet 210-2, a single grommet and corresponding aperture may be formed since the first triangular panel 204-1, the first side panel 502, and the bottom panel 504 couple to one another at the second tab 206-2. Further, as to aperture 208-3 and grommet 210-3, a single grommet and corresponding aperture may be formed since the first triangular panel 204-1, the second side panel 602, and the bottom panel 504 couple to one another at the third tab 206-3. Still further, as to aperture 208-4 and grommet 210-4, a single grommet and corresponding aperture may be formed since the second triangular panel 204-2, the second side panel 602, and the bottom panel 504 couple to one another at the fourth tab 206-4. Similarly, as to aperture 208-5 and grommet 210-5, a single grommet and corresponding aperture may be formed since the second triangular panel 204-2, the first side panel 502, and the bottom panel 504 couple to one another at the fifth tab 206-5.

The storage device 100 may also include a number of ribs 212-1, 212-2, 212-3 (collectively referred to as "rib(s) 212"). The ribs 212 serve to expand the interior of the storage device 100 by separating the first triangular panel 204-1, the second triangular panel 204-2, the first side panel 502, the second side panel 602, and the bottom panel 504 from one another. In this manner, an internal cavity or space may be formed within the storage device 100 to allow for a number of items to be placed therein. The ribs 212 may engage with the grommets 210 to push the panels away from one another as depicted in FIGS. 4 and 5, for example. In one example, a first rib 212-1 may be included within the grommets 210-1 in an example where two grommets are included in the first tab 206-1. This allows for separation between the first triangular panel 204-1 and the second triangular panel 204-2 at a top portion of the storage device 100. However, in one example where a single grommet is employed in association with the first tab 206-1, the first rib 212-1 may be coupled to the single grommet to provide support to the first tab 206-1.

The second tab 206-2 and the fifth tab 206-5 are separated from one another by a second rib 212-2 and, similarly, the third tab 206-3 and the fourth tab 206-4 are separated from one another by a third rib 212-3. The second rib 212-2 may engage with the second grommet 210-2 and the fifth grommet 210-5, and similarly, the third rib 212-3 may engage with the third grommet 210-3 and the fourth grommet 210-4. In one example, the ribs 212 may engage with their respective grommets 210 by forming an engagement end such as a tapered portion in the ends of the ribs 212 such that a center portion of the ribs 212 have a relatively larger diameter with respect to the engagement end. Coupling of the ribs 212 with their respective grommets 210 may be made by engaging a first end of a rib 212 with a first grommet 210 formed at a first tab 206, pulling a second tab 206 opposing the first tab 206 away from the first tab 206 and around the end of the second end of the rib 212 and engaging the second end of the rib 212 with the second grommet 210 formed at the second tab 206.

In one example, the ribs 212 may be removable or disengaged from the grommets 210 to allow the storage device 100 to be collapsible. The collapsibility of the storage device 100 allows for the storage device 100 to be conveniently carried in, for example, a backpack such that a user may carry the storage device 100 and deploy the storage device 100 when it comes time to utilize the storage device 100 for storage of items. For example, when a user makes camp, the storage device 100 may be deployed by engaging the ribs 212 with the respective grommets 210, and items may be placed in the storage device 100. Further, when the user breaks camp, the storage device 100 may be emptied of the items, collapsed by disengaging the ribs 212, and packed away into, for example, a backpack along with the items that were placed therein.

The ribs 212 may be made of a lightweight material in order to maintain the weight of the storage device 100 below a desired or predetermined threshold. For example, the ribs 212 may be made of aluminum pipe since aluminum is a lightweight but strong material. In one example, the ribs 212 may be made of 13 millimeter (mm) aluminum pipe. The ribs 212 may be hollow tubes in order to allow for the tethers 108 to pass through the apertures 208, the grommets 210, and the ribs 212 to allow for the storage device 100 to be hung and secured from movement in at least one coordinate direction as depicted in FIG. 1, for example.

In one example, the ribs 212 may be hollow, spring loaded rods that are spring biased to expand such that the springs included in this example of the ribs 212 push the first triangular panel 204-1 and the second triangular panel 204-2 away from one another to create a space interior to the first triangular panel 204-1, the second triangular panel 204-2, the first side panel 502, and the second side panel 602.

The storage device 100 may further include at least one opening 214 located on at least one of the first triangular panel 204-1, the second triangular panel 204-2, the first side panel 502, the second side panel 602, and combinations thereof. For example, as depicted in FIG. 2, an opening 214 may be defined on the first triangular panel 204-1 to allow for access to the interior of the storage device 100. In one example, an opening 214 may be formed on any of the first triangular panel 204-1, the second triangular panel 204-2, the first side panel 502, the second side panel 602, and combinations thereof.

Further, in one example, the opening 214 may be selectively closed and opened via a number of fasteners to allow for the storage device to be securely closed. For example, the fasteners used to close the opening 214 may include at least one zipper, a number of buttons, a number of snaps, other fasteners, and combinations thereof that may be used to securely close the opening 214. In the example where at least one zipper is included, the opening 214 may be selectively opened and closed with respect to the exterior of the storage device 100. In one example, a first zipper may be used to close the opening 214 on a first side of the opening 214 such as the top portion of the opening 214 located closest to the first side panel 502, and a second zipper may be used to close the opening 214 on a second side of the opening 214 such as the bottom portion of the opening 214 closest to the bottom panel 504. In one example, the zipper and/or the opening 214 may be water-resistant or water proof such that water cannot enter the interior of the storage device 100 when the opening 214 is secured in the closed state via the zipper.

As depicted in FIGS. 1, 2, 4, and 7, a number of loops 216 may be secured to an exterior of the bottom panel 504. The loops 216 may serve as anchors from which other objects may be hung such as, for example, a backpack (via use of a small hook attached between a loop 216 and the backpack), clothes hangers, flashlights or lanterns, and other objects. In the examples of FIGS. 1, 2, 4 and 7, five loops 216 are coupled to the bottom panel 504. However, any number of loops 216 may be coupled to the bottom panel 504 as may be desirable. In one example, the loops 216 may be made of nylon strapping, paracord, or other suitable material. Further, the loops 216 may be sewn, stitched, welded (e.g., chemical welding, heat welding, etc.), taped, glued, or otherwise coupled to bottom panel 504. In one example, the loops 216 may be coupled to any portion of the storage device 100 including, the first triangular panel 204-1, the second triangular panel 204-2, the first side panel 502, the second side panel 602, and the bottom panel 504.

Figure 7:
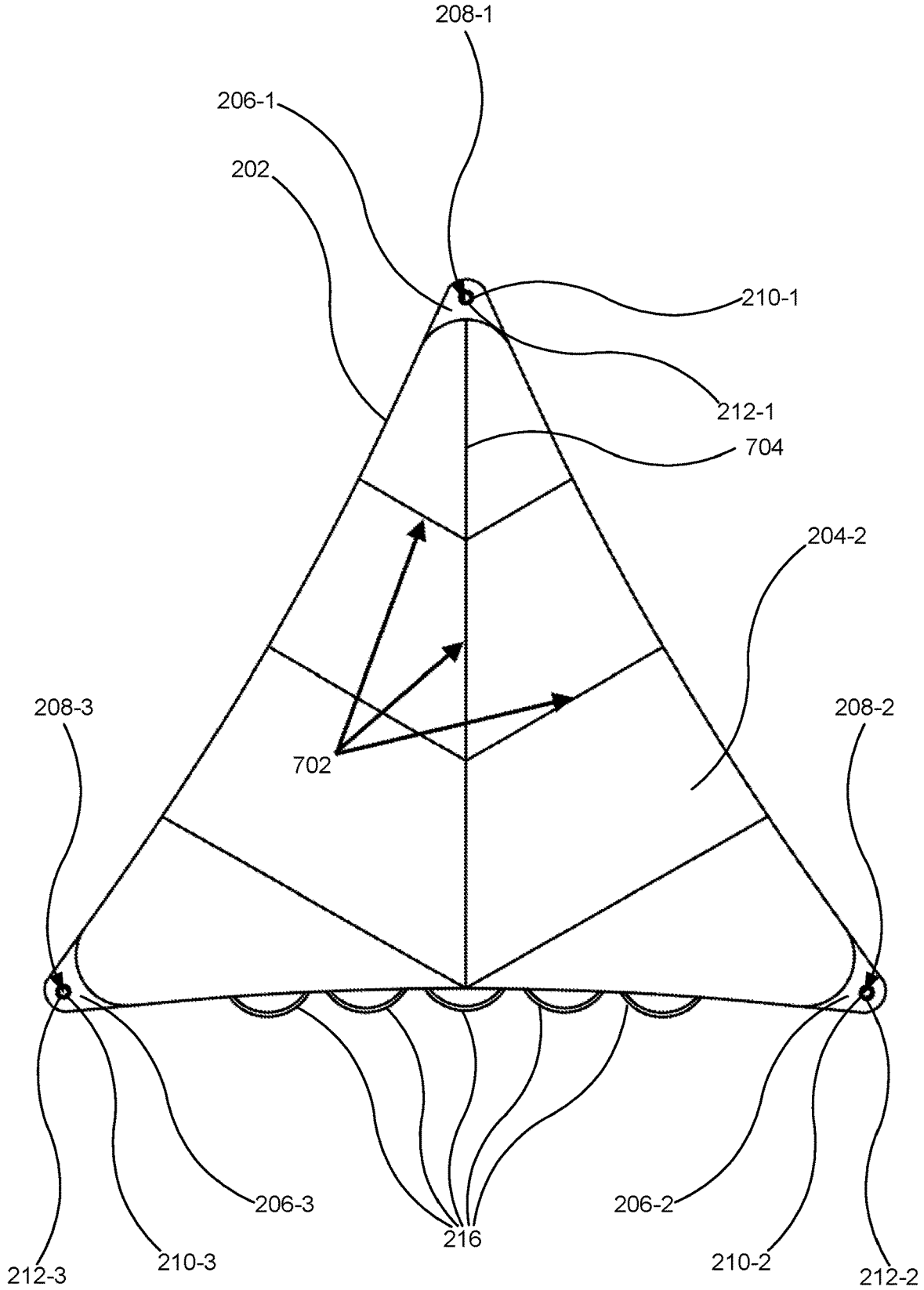
FIG. 7 illustrates a cut-away view of the storage device of FIG. 1, according to an example of the principles described herein.

FIG. 7 illustrates a cut-away view of the storage device 100 of FIG. 1, according to an example of the principles described herein. For example, in FIG. 7, the first triangular panel 204-1 is removed to display the interior of the storage device 100. A number of shelves 702 may be included in the interior of the storage device 100. The shelves 702 may be sewn, stitched, welded (e.g., chemical welding, heat welding, etc.), taped, glued, or otherwise coupled to the interior of the storage device 100. In the example of FIG. 7, the shelves 702 include a main center support 704 extending in a vertical manner from a top of the storage device 100 at the first tab 206-1 to the bottom of the storage device 100 at the bottom panel 504. The shelves 702 may also include a number of horizontal shelves 702 on which objects stored within the storage device 100 may be placed. The horizontal shelves 702 may couple to the main center support 704 and at least one of the first triangular panel 204-1, the second triangular panel 204-2, the first side panel 502, the second side panel 602, and the bottom panel 504.

In one example, at least one of the main center support 704 and/or the horizontal shelves 702 may be made of the same or different material as the first triangular panel 204-1, the second triangular panel 204-2, the first side panel 502, the second side panel 602, and the bottom panel 504. In one example, at least one of the main center support 704 and/or the horizontal shelves 702 may be made of a mesh material. In the example of FIG. 7, the horizontal shelves 702 are depicted as being angled with respect to a true horizontal line. However, the horizontal shelves 702 may be parallel to the bottom panel 504, angled at any slope with respect to the bottom panel 504, and combinations thereof. Further, the main center support 704 and the horizontal shelves 702 may be arranged to create any size of spaces between the horizontal shelves 702 and main center support 704.

CONCLUSION

The examples described herein provide a device including a first triangular panel, a second triangular panel, a first side panel coupling the first triangular panel and the second triangular panel at a first common side of the first triangular panel and the second triangular panel, a second side panel coupling the first triangular panel and the second triangular panel at a second common side of the first triangular panel and the second triangular panel, a bottom panel coupling the first triangular panel, the second triangular panel, the first side panel, and the second side panel, and at least one shelf coupled in an interior of the first triangular panel, the second triangular panel, the first side panel, and the second side panel. With the above-described systems and methods, a user may be able to store objects in an organized manner especially during a hiking or camping situation. The collapsibility and lightweight materials of the storage device allows for the storage device to be used in hiking and camping scenarios in which the use may transport the collapsed storage device in their hiking backpack or similar device and deploy the storage device when a camping area is reached.

While the present systems and methods are described with respect to the specific examples, it is to be understood that the scope of the present systems and methods are not limited to these specific examples. Since other modifications and changes varied to fit particular operating requirements and environments will be apparent to those skilled in the art, the present systems and methods are not considered limited to the example chosen for purposes of disclosure, and covers all changes and modifications which do not constitute departures from the true spirit and scope of the present systems and methods.

Although the application describes examples having specific structural features and/or methodological acts, it is to be understood that the claims are not necessarily limited to the specific features or acts described. Rather, the specific features and acts are merely illustrative of some examples that fall within the scope of the claims of the application.

What is claimed is:

1. A device comprising:

a first triangular panel;

a second triangular panel;

a first side panel coupling the first triangular panel and the second triangular panel at a first common side of the first triangular panel and the second triangular panel;

a second side panel coupling the first triangular panel and the second triangular panel at a second common side of the first triangular panel and the second triangular panel;

a bottom panel coupling the first triangular panel, the second triangular panel, the first side panel, and the second side panel;

a plurality of grommets formed in a plurality of corners of the device, the grommets having a plurality of apertures; and a plurality of ribs extending from an interior side of the first triangular panel to an interior side of the second triangular panel, wherein ends of the ribs engage within the apertures of the grommets.

2. The device of claim 1, further comprising at least one loop coupled to an exterior of the bottom panel.

3. The device of claim 1, wherein the first triangular panel, the second triangular panel, the first side panel, the second side panel, and the bottom panel include a water-resistant or water-proof material.

4. The device of claim 1, wherein the plurality of ribs include aluminum.

5. The device of claim 1, wherein the plurality of ribs are configured to engage with a respective pair of the grommets.

6. The device of claim 1, further comprising an opening located on at least one of the first triangular panel or the second triangular panel.

7. The device of claim 6, wherein the opening includes at least one zipper coupled to the opening to selectively open and close the opening.

8. The device of claim 1, further comprising a shelf coupled in an interior of the first triangular panel, the second triangular panel, the first side panel, and the second side panel.

9. The device of claim 8, wherein the shelf includes a mesh material.

10. A rectangular pyramid storage device, comprising:

a first triangular panel;

a second triangular panel;

a first side panel coupling the first triangular panel and the second triangular panel at a first common side of the first triangular panel and the second triangular panel;

a second side panel coupling the first triangular panel and the second triangular panel at a second common side of the first triangular panel and the second triangular panel;

a bottom panel coupling the first triangular panel, the second triangular panel, the first side panel, and the second side panel;

a plurality of grommets formed in a plurality of corners of the device, the grommets having a plurality of apertures; and a plurality of ribs extending from an interior side of the first triangular panel to an interior side of the second triangular panel, wherein ends of the ribs engage within the apertures of the grommets.

11. The rectangular pyramid storage device of claim 10, further comprising at least one shelf coupled in an interior of the first triangular panel, the second triangular panel, the first side panel, and the second side panel.

12. The rectangular pyramid storage device of claim 11, wherein the at least one shelf includes a mesh material.

13. The rectangular pyramid storage device of claim 10, further comprising at least one loop coupled to an exterior of the bottom panel.

14. The rectangular pyramid storage device of claim 10, wherein the plurality of ribs is configured to engage with a respective pair of the grommets.

15. The rectangular pyramid storage device of claim 10, wherein the plurality of ribs include aluminum.

16. The rectangular pyramid storage device of claim 10, further comprising an opening located on at least one of the first triangular panel or the second triangular panel.

17. The rectangular pyramid storage device of claim 16, wherein the opening includes at least one zipper coupled to the opening to selectively open and close the opening.

* * * * *